US006578286B2

(12) United States Patent
Seeley

(10) Patent No.: US 6,578,286 B2
(45) Date of Patent: Jun. 17, 2003

(54) CLOTHES DRYER VENT ADAPTER

(76) Inventor: Gene Seeley, 311 Sand Dune Ave., SW. Ocean Shores, WA (US) 98569

( * ) Notice: Subject to any disclaimer, the term of this patent is extended or adjusted under 35 U.S.C. 154(b) by 0 days.

(21) Appl. No.: 09/782,747

(22) Filed: Feb. 12, 2001

(65) Prior Publication Data

US 2002/0108265 A1 Aug. 15, 2002

(51) Int. Cl.[7] ..... F26B 25/00
(52) U.S. Cl. ..... 34/138; 34/235
(58) Field of Search ..... 285/145.1, 145.2, 285/147.1, 302, 303, 181, 182, 272, 273, 274, 275, 276, 277, 278, 279, 280, 281, 282; 34/417, 87, 108, 109, 602, 603, 140, 235, 138

(56) References Cited

U.S. PATENT DOCUMENTS

| | | | | | |
|---|---|---|---|---|---|
| 897,700 | A | | 9/1908 | Ashbaugh | |
| 1,304,980 | A | | 5/1919 | Hirshstein | |
| 1,409,022 | A | * | 3/1922 | Paxton | 285/181 |
| 2,447,947 | A | | 8/1948 | Larson et al. | 285/122 |
| 2,581,047 | A | | 1/1952 | Salmond et al. | 285/123 |
| 2,825,586 | A | * | 3/1958 | Robboy | 285/181 |
| D215,003 | S | | 8/1969 | Stevens et al. | D23/151 |
| 3,704,034 | A | * | 11/1972 | Shire et al. | 284/47 |
| 3,960,142 | A | | 6/1976 | Elliott et al. | 128/2.08 |
| 4,071,268 | A | | 1/1978 | Halling et al. | 285/95 |
| D273,702 | S | | 5/1984 | Widerby et al. | D23/163 |
| 4,890,396 | A | | 1/1990 | King | 34/235 |
| 4,989,347 | A | | 2/1991 | Kretchman | 34/133 |
| 5,066,050 | A | | 11/1991 | Kretchman | 285/319 |
| 5,121,948 | A | * | 6/1992 | Anderson et al. | 285/168 |
| 5,145,217 | A | * | 9/1992 | Anderson et al. | 285/179 |
| 5,158,328 | A | * | 10/1992 | Anderson et al. | 285/168 |
| 5,584,129 | A | | 12/1996 | Williamson | 34/235 |
| 5,645,482 | A | * | 7/1997 | Moss et al. | 454/339 |
| 5,819,435 | A | | 10/1998 | Tuggle | 34/235 |
| 5,887,908 | A | * | 3/1999 | White | 285/147.1 |

* cited by examiner

*Primary Examiner*—Ira S. Lazarus
*Assistant Examiner*—K. B. Rinehart
(74) *Attorney, Agent, or Firm*—R. Reams Goodloe, Jr.

(57) ABSTRACT

A clothes dryer adapter. The adapter includes (a) a first cylindrical portion with a generally cylindrical tubular segment having a first longitudinal axis, a inlet portion, an inlet end cap located at an effective inlet end, and an outlet end, and (b) a second cylindrical portion interfittingly engaging the first cylindrical portion for rotatable adjustment with respect thereto. the second cylindrical portion is similar to the first cylindrical portion, and has an inlet end, an outlet end cap located at an effective outlet end, and an outlet portion for discharge of hot dryer exhaust air therefrom. The two portions are rotatably adjustable, before assembly, but sized and shaped for interfitting mating engagement to form a sturdy, sealable dryer vent when fully assembled, having an inlet portion and an outlet portion with parallel but offset longitudinal axes.

30 Claims, 4 Drawing Sheets

CLOTHES DRYER VENT ADAPTER

A portion of the disclosure of this patent document contains material which is subject to copyright protection. The owner has no objection to the facsimile reproduction by anyone of the patent document or the patent disclosure, as it appears in the Patent and Trademark Office patent file records, but otherwise reserves all copyright rights whatsoever.

TECHNICAL FIELD

My invention relates to dryer vents, and more particularly, to dryer vents which can be manufactured in a desired size and simply attached to achieve alignment between a dryer outlet and a discharge vent line.

BACKGROUND

In residential construction, whether in single family residences, or in apartments, or otherwise, it is common practice to provide space to accommodate space for, and operable connection of, an electric or gas heated dryer. The builder of the residence generally will install an outlet receptacle for hot air discharged from a dryer, either in a location as indicated in the plans, or in a location where the construction workers judge most practical. Accepted building practice generally results in locating a dryer vent receptacle in the general vicinity of the required location, yet, still slightly mislocated with respect to the clothes dryer hot air exhaust outlet. Most modern clothes dryers have a hot air exhaust which is centered in the rear of the dryer, and most often located about five inches above the floor. Because of various reasons, such as (a) final floor height has not been established at time the receptacle is placed in the wall, (b) a pipe, drain, stud, is in the way, or (c) the fact that clothes dryers come in various sizes with varying outlet heights and varying lateral location of the hot air exhaust outlet, inevitably a need arises for an adjustment to be made, either at the dryer hot air exhaust outlet, or at the receptacle in the wall. Devices to correct large misalignments are available, such as flexible plastic or metal tube and extensible ducts. However, it would be desirable if suitable devices for correction of small misalignments were available. Importantly, the misalignment is usually small, often within three or four inches, although it may be in any direction, i.e., up, down, left, right, or any angular direction in between.

Even though various dryer adapters have been developed over years of practical experience, it would still be quite desirable to reduce the time and aggravation which must necessarily be incurred in the installation of a dryer. In particular, labor saving techniques, i.e., changes in the apparatus which would reduce the cost of installation, would be welcome by the contractors charged with installing such dryers, and simplified structures to facilitate quick installation would be most welcome by the "do-it-yourself" homeowner.

OBJECTS, ADVANTAGES, AND NOVEL FEATURES

It is the object of my invention to provide a novel dryer vent adapter that is easily assembled from opposing slip-fit cylindrical portions.

It is an object of the invention to provide an adapter that allows a dryer to fit tightly against a wall, without having to be concerned with restricted airflow through crushed and/or contorted vent ducts.

Importantly, for installing a dryer, inter-engaging first and second slip-fit cylindrical portions are rotatably adjustable with respect each to the other, so that any angular position can be achieved, in order to correct the misalignment, and thus provide inlets and outlets at precisely the required location.

It is an advantage that my dryer adapter provides a secure, sheet metal housing for hot dryer exhaust air. rather than requiring the use of flexible plastic or other less robust materials.

Further, it is another advantage of my dryer adapter design that the inlet section of the first cylindrical portion can be aligned with the outlet section of the second cylindrical portion, so that if perchance there is no misalignment between the receptacle and the dryer hot exhaust outlet, then my adapter can function to join the parts without need to resort to a still different connector.

From the foregoing, it will be apparent to the reader that one very key, important and primary object of the present invention resides in the provision of a novel, rotatably adjustable dryer vent adapter which simplifies the installation of clothes dryers in a variety of possible dimensions. This is done by providing a first cylindrical portion having an inlet tube and an inlet cap, and a second cylindrical portion having an outlet tube and an outlet cap, each of the cylindrical portions can be rotably adjusted with respect to the other, and each having interlocking edges and flanges for precisely and securely interfitting the mating surfaces of each of the first and second cylindrical portions, so that they are easily joined into a finished, sealed, substantially leakless dryer vent adapter.

Other important but more specific objects of the invention reside in the provision of a clothes dryer vent adapter as described herein which:

- can be manufactured in preselected size, including overall diameter, inlet and outlet tube configuration, and inlet and outlet tube location on the first and second cylindrical portions, to provide a tight fitting finished clothes dryer vent of preselected size;
- can be manufactured in a simple, straightforward manner to provide a sturdy, strong, long lasting dryer vent adapter;
- which in a relatively inexpensive manner can reduce inventory costs at the distribution level, and can increase the flexibility of the field assembly to provide a useful and simple dryer vent
- can be manufactured in a suitable material, including sheet metal, to match the desired hot air outlet duct requirements of local governmental authorities.
- can be provided ready to install, with inlets and outlets of predetermined size, to match the most commonly utilized dryer vent system sizes.
- can be finished with a substantially liquid gas tight sealed joint utilizing duct tape or the like on sheet metal, to substantially resist leakage of hot exhaust air containing water vapor through the joints occurring at the adapter, i.e., between the clothes dryer and the outlet receptacle provided.

Other important objects, novel features, and additional advantages of my invention will become apparent to the reader from the foregoing and from the appended claims and as the ensuing detailed description and discussion proceeds in conjunction with the accompanying drawing.

SUMMARY

I have now invented and disclose herein a novel two part, rotatable dryer vent adapter. The dryer vent adapter includes a first, somewhat pie-pan shaped cylindrical portion with a generally cylindrical tubular segment having a first longitudinal axis, a inlet portion, an inlet end cap located at an effective inlet end, and an outlet end, and a second, somewhat pie-pan shaped cylindrical portion interfittingly engaging the first cylindrical portion for rotatable adjustment with respect thereto. The second cylindrical portion is similar to the first cylindrical portion, and has an inlet end, an outlet end cap located at an effective outlet end, and an outlet portion for discharge of hot dryer exhaust air therefrom. The two portions are rotatably adjustable, before assembly, but sized and shaped for interfitting mating engagement to form a sturdy, sealable dryer vent when fully assembled. Importantly, the device provides a dryer vent adapter having an inlet portion and an outlet portion with parallel but offset longitudinal axes.

My novel dryer vent adapter system provides a simple, foolproof design for installation of common residential clothes dryers of various designs. This dryer vent adapter design provides a significant improvement in the art by reducing complexity of installation of dryers, by providing a uniform unit design, and thus reducing inventory costs for carrying the necessary parts to provide installation of dryers in various situations.

DESCRIPTION

Figure 1:
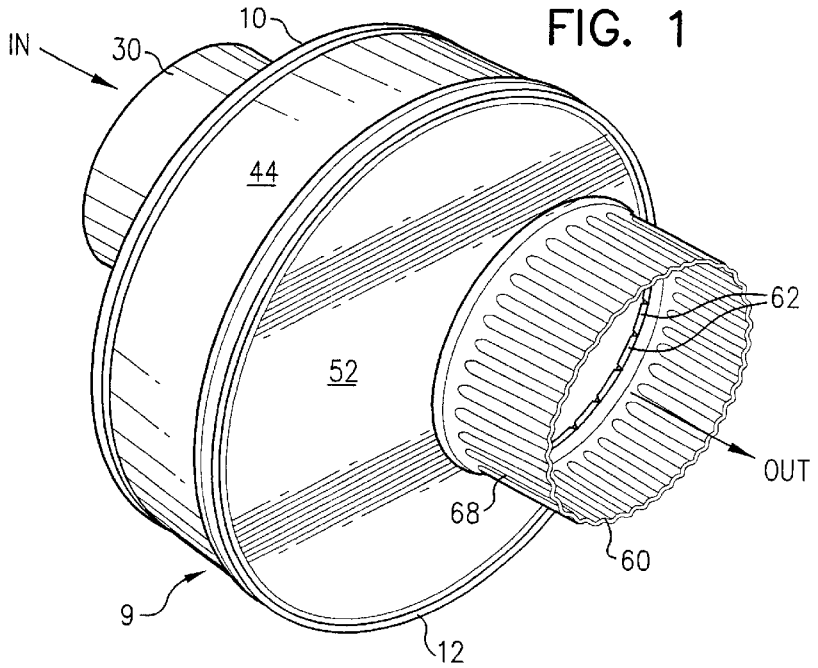
FIG. 1 is a perspective view of my clothes dryer vent adapter, shown in the hand of a workman, in readiness for fitting in order to install a clothes dryer.
Figure 2:
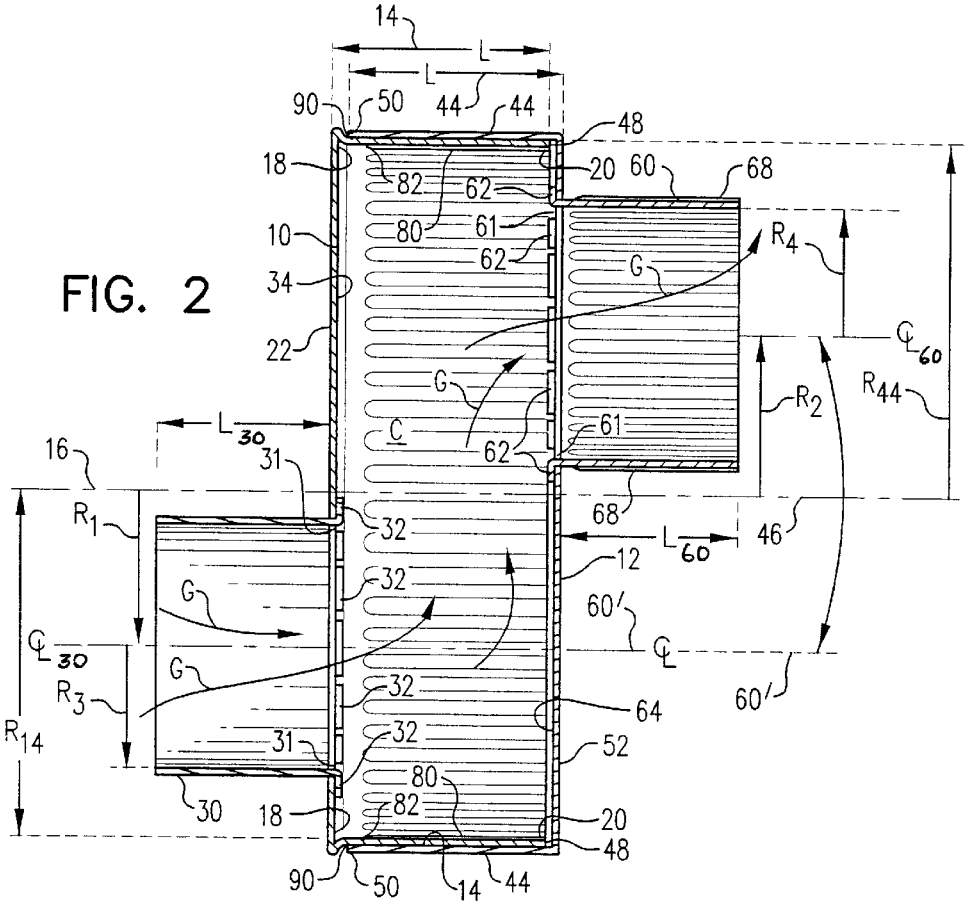
FIG. 2 is a vertical cross-sectional view of my dryer adapter, showing the first cylindrical portion with inlet tube and inlet cap, and the second cylindrical portion with outlet tube and outlet cap, and the inter-engaging flanges which allow a secure fit between the first and second cylindrical portions.

Attention is directed to FIG. 1 of the drawing, where a clothes dryer vent adapter 9 is illustrated in a fully assembled position, and to FIG. 2 of the drawing, where a vertical cross-sectional view is provided to illustrate the various components of my dryer vent adapter 9. The vent adapter 9 has a somewhat pie-pan shaped first generally cylindrical portion 10, and a somewhat pie-pan shaped second generally cylindrical portion 12. These first and second generally cylindrical portions are interfittingly engagable for rotation each with respect to the other, prior to assembly.

The first cylindrical portion 10 has a substantially cylindrical tubular segment 14 having a first longitudinal axis 16 and a radius $R_{14}$, an effective inlet end 18, and an outlet end 20. An inlet end cap 22 is provided, affixed to the effective inlet end 18 of the substantially cylindrical tubular segment 14. Preferably, the inlet end cap 22 is provided oriented transversely to the first longitudinal axis 16. An inlet portion 30 is provided, preferably tubular, and more preferably in the form of a third substantially cylindrically tube in shape. The inlet portion 30 extends for a length $L_{30}$ along a centerline denoted as centerline $CL_{30}$. The inlet portion 30 is sealingly affixed at an outlet end 31 to the inlet end cap 22. Ideally, this is accomplished via use of a starting collar having a plurality of precut tabs 32, with the precut tabs 32 securely affixed to the interior wall portion 34 of the inlet end cap 22.

The second cylindrical portion 12 has a substantially cylindrical tubular segment 44 having a second longitudinal axis 46, a radius $R_{44}$, an inlet end 50, and an effective outlet end 48. An outlet end cap 52 is provided, affixed to the effective outlet end 48 of the substantially cylindrical tubular segment 44. Preferably, the outlet end cap 52 is oriented transversely to the second longitudinal axis 46. An outlet portion 60 is provided, preferably tubular, and more preferably cylindrically tubular in shape. The outlet portion 60 extends from an inlet end 61 outward for a length $L_{60}$ along a centerline denoted as centerline $CL_{60}$. Ideally, the outlet portion 60 provides a fourth substantially cylindrical tubular portion, that is sealingly affixed to the outlet end cap 52. Ideally, this is accomplished, at least in part, via use of a starting collar having a plurality of precut tabs 62, with the precut tabs 62 securely affixed to the interior wall portion 64 of the outlet end cap 52. For attachment to a dryer exhaust receptacle (not shown) in a building structure, I prefer to provide the tubular outlet portion 60 with flutes 68.

For providing secure assembly, I prefer that the inlet or first cylindrical portion 14 be provided with fluting 80 approaching the outlet end 20, and, more preferably, that the fluting 80 is provided between the outlet end 20 and a point 82 that is near, but spaced toward the outlet end 20 from the inlet end cap 22.

Importantly, the dryer vent adapter 9 as described herein includes first 10 and said second 12 cylindrical portions that are freely rotatable, before assembly, with 360 degrees of freedom, but that are secured, after assembly, in a tight, non-slip engagement fashion. In this manner, the joint 90 therebetween can be sealed in conventional fashion, such as by duct tape, after the desired orientation is achieved. In any event, it is important to realize that the inlet portion 30 and the outlet portion 60 are adjustably alignable along a common longitudinal axis, shown in FIG. 2 as the combination of $CL_{30}$ and $CL_{60}'$, or, alternately, as also shown in FIG. 2, that the outlet portion 60 can be adjusted anywhere over 180 degrees, of rotation, so that the centerline thereof may vary anywhere between $CL_{60}$ and $CL_{60}'$ wherein the inlet portion 30 and the outlet portion 60 are adjustably alignable along parallel but offset longitudinal axes.

For conventional construction in the United States, I have found that it is convenient to provide the dryer vent adapter in a nominal overall diameter D of eight (8) inches, equal to approximately 2 times $R_{14}$ (inside diameter) as indicated in FIG. 2, and as will be understood by those of ordinary skill in the art and to whom this disclosure is directed. In such cases, the inlet portion 30 is normally provided with a nominal overall diameter of four (4) inches. Also, it is customary to provide an outlet portion 60 of equivalent diameter to the inlet, or of four (4) inches in diameter.

Figure 7:
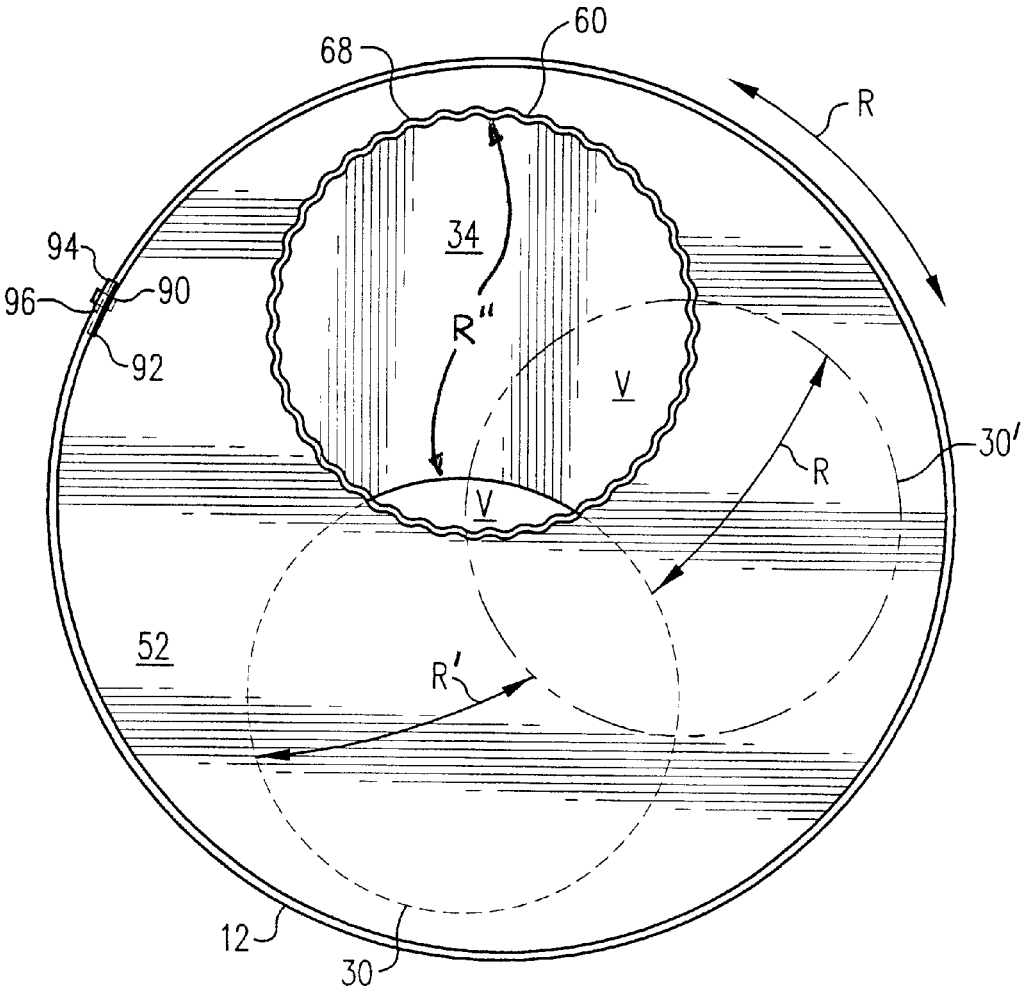
FIG. 7 is a vertical elevation view, showing the outlet side of a second embodiment of an assembled adapter, showing the inlet portion in a first position relative to the outlet portion, and also showing in double broken lines, a second possible location for the inlet portion relative to the outlet portion.

My novel dryer vent adapter 9, as described herein, utilizes first 10 and second 12 cylindrical portions that are freely rotatable, before assembly, with 360 degrees of freedom, so that the inlet 30 and outlet 60 portions are adjustable between (a) a first position wherein the inlet portion 30 and outlet portion 60 are oriented along a common longitudinal axis, and (b) a second position where the inlet portion 30 and said outlet portion 60 are oriented along parallel but offset longitudinal axes. In one commonly utilized configuration, where the overall diameter of the first 10 and second 12 cylindrical portions are of a nominal eight (8) inches in diameter, where the inlet portion 30 and said outlet portion 60 are each provided in a nominal four (4) inch diameter, I have found that the configuration provides for any desired correction distance R, from zero (0.0) inches to about three and seven tenths (3.7) inches of offset. In FIG. 7, various correction distances of R, R', and R" are illustrated. Note that as depicted with closely located inlet portion 30 and outlet portion 60, the configuration provides a free area portion V, or V' extending clear through the dryer vent adapter 9 along a common longitudinal axis. For installation purposes, the correction angle desired can be pre-marked on applicable parts.

Although any desired overall diameter D (discussed above) or length $L_{44}$ of tubular portion 44, or length $L_{14}$ of tubular portion 14 can be utilized consistent with a dryer adapter 9 of selected size, it is important to provide components with an interfitting, or at least a rotatable engagement design, as depicted, or another functional equivalent. For example, the invention may be alternately described as having two basic parts, an inlet section 10 and an outlet section 12. The inlet section 10 has an inlet circular peripheral edge portion, an inlet end cap 22, and a tubular inlet portion 30. Likewise, the outlet section 12 has an outlet circular peripheral edge portion, and outlet end cap 52, and a tubular outlet portion 60 sealingly affixed to the outlet end cap 52. The inlet section 10 and the outlet section 12 may be, but not necessarily need be, provided in a generally "circular pie-pan" shape as mentioned above. The inlet circular peripheral edge portion and the outlet circular peripheral edge portion are configured for mating engagement to provide a substantially sealed assembly forming a chamber C (see FIG. 2) for passage of gas therethrough, as also depicted by arrows G in FIG. 2. Importantly, the inlet section 10 and the outlet section 12 are, before final assembly, each freely rotatable with respect to each other.

Figure 3:
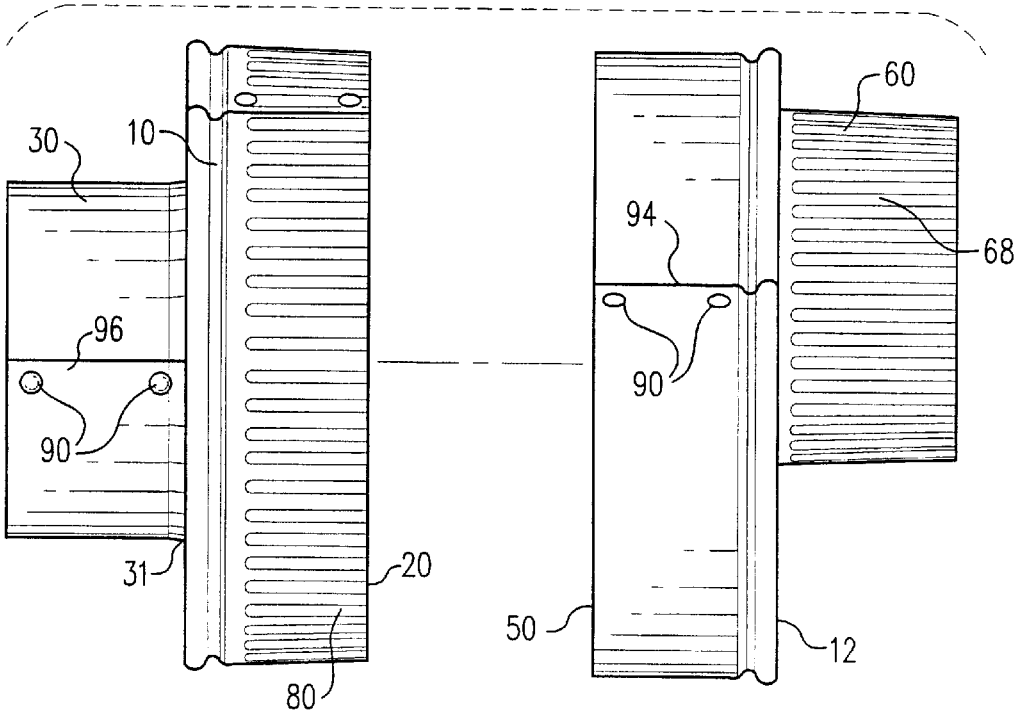
FIG. 3 is a perspective view, showing, in unassembled position, the first and second cylindrical portions of the dryer vent adapter.
Figure 4:
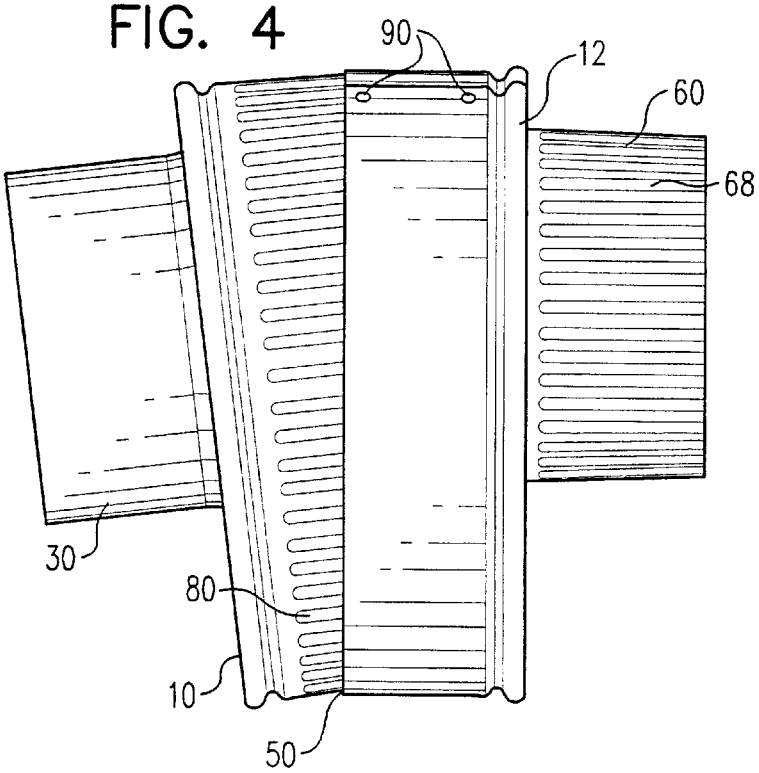
FIG. 4 is a perspective view, showing the first and second cylindrical portions of the dryer vent adapter being assembled.
Figure 5:
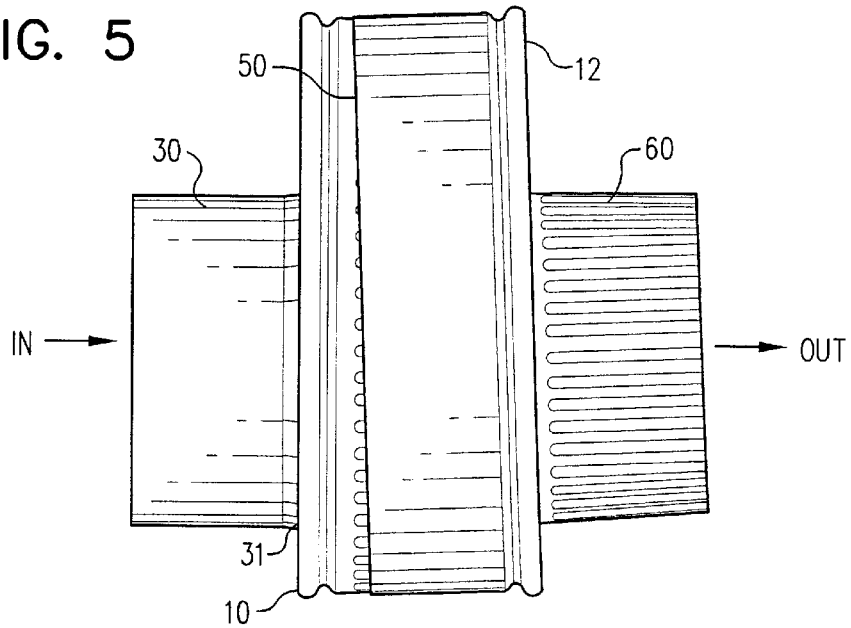
FIG. 5 is a perspective view, showing the first and second cylindrical portions of the dryer, similar to the view just provided in FIG. 4, but showing the reverse side, and slightly more fully assembled.
Figure 6:
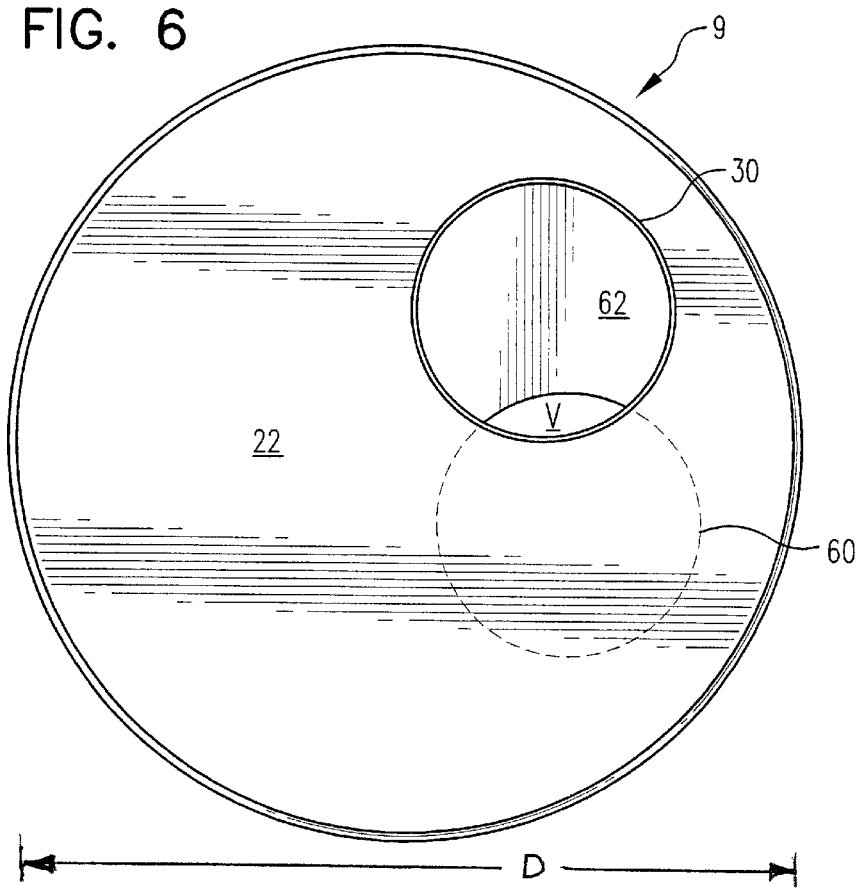
FIG. 6 is a vertical elevation view, showing the inlet side of a first embodiment of my fully assembled dryer adapter, ready for installation, for use in the case where the misalignment being corrected is slight, so "daylight" can be seen through a visible portion V which is provided in a concave alignment aperture region.

Also, it can be noted from FIGS. 3 and 7 that the generally cylindrical tubular segments 14 and 44 can each be formed via use of lengths of sheet metal, with pop rivets 90 or other suitable fasteners. In FIG. 7, for example, cylindrical tubular segment 44 has a first end 92, and a second end 94, with an overlapping portion 96, wherethrough pop-rivets 90 are affixed.

Various other details are sufficiently set forth in the drawing as provided herein to enable one of ordinary skill in the art to make and use the invention, and need not be further described by additional writing in this detailed description.

It is to be appreciated that my dryer vent adapter vent is an important improvement in the state of the art of dryer vent adapters, especially for providing an adapter to accommodate misalignment of dryer exhaust outlets and hot exhaust receptacles, without taking up excess floor space or resorting to flexible tubing. Although only a few exemplary embodiments of this invention have been described in detail, it will be readily apparent to those skilled in the art that the my novel dryer vent adapter may be modified from those embodiments provided without materially departing from the novel teachings and advantages provided by this invention, and may be embodied in other specific forms without departing from the spirit or essential characteristics thereof. For example, these adapters can be made in a variety of materials, including galvanized sheet metal, aluminum, aluminum alloys, suitable plastics, suitable rubber compositions, and various composite materials. Also, other manufacturing processes may be utilized to provide parts achieving the same results with slightly different structure, such as vacuum forming, deep drawing, or injection molding. Moreover, the design need not be limited exclusively to dryer vents, and can be utilized in other ductwork applications as necessary to correct similar misalignment problems. Therefore, the embodiments presented herein are to be considered in all respects as illustrative and not restrictive. As such, this disclosure is intended to cover the structures described herein, and not only structural equivalents thereof, but also equivalent structures. Thus, the scope of the invention, as indicated by the drawing and by the foregoing description, is intended to include variations from the embodiments provided which are nevertheless described by the broad meaning and range properly afforded to the plain meaning of the description set forth herein.

What is claimed is:

1. A clothes dryer adapter, said adapter comprising:

(a) a first cylindrical portion, said first cylindrical portion comprising (i) a generally cylindrical tubular segment having a first longitudinal axis, an effective inlet end, and an outlet end (ii) an inlet end cap, said inlet end cap affixed to said effective inlet end of said generally cylindrical tubular segment, and (iii) an inlet portion;

(b) a second cylindrical portion, said second cylindrical portion interfittingly engaging said first cylindrical portion for rotatable adjustment with respect thereto, and further comprising (i) a generally cylindrical tubular segment having a second longitudinal axis, an inlet end, and an effective outlet end, (ii) an outlet end cap, said outlet end cap affixed to said effective outlet end of said generally cylindrical tubular segment, and (iii) an outlet portion.

2. The dryer vent adapter as set forth in claim 1, wherein said inlet end cap is substantially transversely oriented with respect to said first longitudinal axis.

3. The dryer vent adapter as set forth in claim 1, wherein said outlet end cap is substantially transversely oriented with respect to said second longitudinal axis.

4. The dryer vent adapter as set forth in claim 1, wherein said inlet portion comprises a third cylindrical tubular portion having an outlet end, said outlet end of said third cylindrical tube sealingly affixed to said inlet end cap.

5. The dryer vent adapter as set forth in claim 1, wherein said outlet portion comprises a fourth substantially cylindrical tubular portion having an inlet end, said inlet end sealingly affixed to said outlet end cap.

6. The dryer vent as set forth in claim 1, wherein said outlet portion comprises a sidewall portion, and wherein said sidewall portion is fluted.

7. The dryer vent as set forth in claim 5, wherein said substantially cylindrical tubular portion is fluted.

8. The dryer vent adapter as set forth in claim 1, wherein said outlet end of said first cylindrical portion is fluted approaching said outlet end.

9. The dryer vent adapter as set forth in claim 8, wherein said first cylindrical portion is fluted between said outlet end and a point that is near, but spaced toward said outlet end from said inlet end cap.

10. The dryer vent adapter as set forth in claim 1, wherein said first and said second cylindrical portions are freely rotatable, before assembly, with 360 degrees of freedom, but are secured, after assembly, in tight, non-slip engagement.

11. The dryer vent adapter as set forth in claim 1, wherein said inlet and said outlet are adjustably alignable along a common longitudinal axis.

12. The dryer vent adapter as set forth in claim 1, wherein said dryer vent has a nominal overall diameter D, and wherein said overall diameter is approximately eight (8) inches.

13. The dryer vent adapter as set forth in claim 12, wherein said inlet portion has a nominal overall diameter of approximately 4 inches.

14. The dryer vent adapter as set forth in claim 12, wherein said outlet portion has a nominal overall diameter of approximately four (4) inches.

15. The dryer vent adapter as set forth in claim 1, wherein said first and said second cylindrical portions are freely rotatable, before assembly, to a position wherein said inlet portion and said outlet portion are 180 degrees opposed, but are secured, after assembly, in tight, non-slip engagement.

16. The dryer vent adapter as set forth in claim 1, wherein said inlet portion further comprises a starting collar having a plurality of precut tabs, and wherein said precut tabs are securely affixed to said interior portion of said inlet end cap.

17. The dryer vent adapter as set forth in claim 1, wherein said outlet portion further comprises a starting collar having a plurality of precut tabs, and wherein said precut tabs are securely affixed to said interior portion of said outlet end cap.

18. A clothes dryer adapter, said adapter comprising:

(a) a first cylindrical portion, said first cylindrical portion comprising
  (i) a generally cylindrical tubular segment having a first longitudinal axis, an effective inlet end, and an outlet end
  (ii) an inlet end cap, said inlet end cap transversely oriented with respect to said first longitudinal axis, and affixed to said effective inlet end of said generally cylindrical tubular segment, and
  (iii) an inlet portion;

(b) a second cylindrical portion, said second cylindrical portion interfittingly engaging said first cylindrical portion for rotatable adjustment with respect thereto, and further comprising
  (i) a generally cylindrical tubular segment having a second longitudinal axis, an inlet end, and an effective outlet end,
  (ii) an outlet end cap, said outlet end cap transversely oriented with respect to said second longitudinal axis, and affixed to said effective outlet end of said generally cylindrical tubular segment, and
  (iii) an outlet portion.

19. The dryer vent adapter as set forth in claim 18, wherein said first and said second cylindrical portions are freely rotatable, before assembly, with 360 degrees of freedom, so that said inlet and said outlet portions are adjustable between (a) a first position wherein said inlet and outlet are oriented along a common longitudinal axis, and (b) a second position where said inlet and said outlet are oriented along parallel but offset longitudinal axes, and wherein said inlet and said outlet each have a free area portion extending clear through said dryer vent adapter along a common longitudinal axis.

20. The dryer vent adapter as set forth in claim 19, wherein said dryer vent has a nominal overall diameter D, and wherein said overall diameter is approximately eight (8) inches.

21. The dryer vent adapter as set forth in claim 20, wherein said inlet portion has a nominal overall diameter of approximately four (4) inches.

22. The dryer vent adapter as set forth in claim 20, wherein said outlet portion has a nominal overall diameter of approximately four (4) inches.

23. A dryer vent adapter, said adapter comprising:

(a) an inlet section, said inlet section comprising
  (i) a inlet circular peripheral edge portion,
  (ii) an inlet end cap, said inlet end cap having an interior portion, and
  (iii) a tubular inlet portion, said tubular inlet portion having an outlet end sealingly affixed to, or integrally manufactured with, said inlet end cap; and (b) an outlet section, said outlet section comprising
  (i) an outlet circular peripheral edge portion,
  (ii) an outlet end cap, said outlet end cap having an interior portion, said outlet end cap having a circular pie-pan shape and at the periphery thereof, sealingly affixed to, or integrally manufactured with, said outlet circular peripheral edge portion;
  (iii) a tubular outlet portion, said tubular outlet portion having an inlet end sealingly affixed to said outlet end cap;

(c) said inlet circular peripheral edge portion and said outlet peripheral edge portion configured for mating engagement to provide a substantially sealed assembly forming a chamber for passage of gas therethrough, and (d) wherein said inlet section and said outlet section are, before final assembly, are each freely rotatable with respect to each other.

24. The dryer vent adapter as set forth in claim 23, wherein said inlet portion further comprises an outlet end having a starting collar, said starting collar having a plurality of precut tabs, and wherein said precut tabs are securely affixed to said interior portion of said inlet end cap, and wherein said inlet portion is sealingly affixed to said inlet end cap.

25. The dryer vent adapter as set forth in claim 23, wherein said outlet portion further comprises an inlet end having a starting collar, said starting collar having a plurality of precut tabs, and wherein said precut tabs are securely affixed to said interior portion of said outlet end cap, and wherein said outlet portion is sealingly affixed to said inlet end cap.

26. An adapter for correction of misalignments in air ducts, said adapter comprising:

(a) a first cylindrical portion, said first cylindrical portion comprising
  (i) a generally cylindrical tubular segment having a first longitudinal axis, an effective inlet end, and an outlet end
  (ii) an inlet end cap, said inlet end cap affixed to said effective inlet end of said generally cylindrical tubular segment, and
  (iii) an inlet portion;

(b) a second cylindrical portion, said second cylindrical portion interfittingly engaging said first cylindrical portion for rotatable adjustment with respect thereto, and further comprising (i) a generally cylindrical tubular segment having a second longitudinal axis, an inlet end, and an effective outlet end, (ii) an outlet end cap, said outlet end cap affixed to said effective outlet end of said generally cylindrical tubular segment, and (iii) an outlet portion.

27. The adapter as set forth in claim 26, wherein said inlet end cap is substantially transversely oriented with respect to said first longitudinal axis.

28. The adapter as set forth in claim 26, wherein said let end cap is substantially transversely oriented with respect to said second longitudinal axis.

29. The adapter as set forth in claim 26, wherein said inlet portion comprises a third cylindrical tubular portion having an outlet end, said outlet end of said third cylindrical tube sealingly affixed to said inlet end cap.

30. The dryer vent adapter as set forth in claim 26, wherein said outlet portion comprises a fourth substantially cylindrical tubular portion having an inlet end, said inlet end sealingly affixed to said outlet end cap.

* * * * *